US005261364A

United States Patent [19]

Baldassini

[11] Patent Number: 5,261,364

[45] Date of Patent: Nov. 16, 1993

[54] TIMING APPARATUS FOR TWO-STROKE ENGINES

[76] Inventor: Lando Baldassini, Via della Fortezza 6, S. Piero A Sieve, Florence, Italy

[21] Appl. No.: 907,712

[22] Filed: Jul. 2, 1992

[30] Foreign Application Priority Data

Jul. 4, 1991 [IT] Italy ..... FI91A0164

[51] Int. Cl.[5] ..... F02B 75/32

[52] U.S. Cl. ..... 123/197.4; 74/413

[58] Field of Search ..... 123/197.1, 197.4, 192.1; 74/595, 390, 413

[56] References Cited

U.S. PATENT DOCUMENTS 3,301,244 1/1967 Renshaw ..... 123/197.1
3,861,239 1/1975 McWhorter ..... 123/197.4
4,073,196 2/1978 Dell ..... 123/197.1
4,319,546 3/1983 Beder ..... 123/197.4
4,526,141 7/1985 Catchpole ..... 123/197.4
5,067,456 11/1991 Beachley et al. ..... 123/197.4

FOREIGN PATENT DOCUMENTS 8808095 10/1988 PCT Int'l Appl. ..... 123/197.4

*Primary Examiner*—David A. Okonsky
*Attorney, Agent, or Firm*—McGlew and Tuttle

[57] ABSTRACT

A timing apparatus for an engine having a drive shaft and a gear box shaft parallel to the drive shaft. Each of the shafts having a toothed wheel eccentrically keyed thereto. The toothed wheels engaging each other so that when the gear box shaft rotates at a constant speed, the drive shaft runs half a turn at a minimum speed and half a turn at a maximum speed.

6 Claims, 1 Drawing Sheet

TIMING APPARATUS FOR TWO-STROKE ENGINES

FIELD OF THE INVENTION

The present invention refers to a timing apparatus in a two-stroke internal combustion engine.

BACKGROUND OF THE INVENTION

It is known that in the timing of two-stroke internal combustion engines suitable scavenge and exhaust ports are provided, to let the fuel into the combustion engine and, respectively, to allow exhaust gas to be discharged.

However, in these engines, the height of said ports, especially the exhaust ones, depend strictly on the cylinder capacity, that is, on the maximum flow rate of the admitted fuel and exhaust gas, so that it is not possible to reduce the dimensions below a certain limit. As a result, it is not possible to utilize the whole volume available between the piston head at the bottom dead center, and the cylinder head vault. In other words, since, for the reason stated above, the actual cylinder capacity of the engine is approximately 35-40% less than the theoretical one, if a higher power is required, then it is necessary to provide a larger combustion chamber and, accordingly, a heavier and bulkier engine.

SUMMARY AND OBJECTS OF THE INVENTION

The main object of the present invention is to overcome the above mentioned drawback and provide an increased useful cylinder capacity, the total cylinder capacity being equal.

This result has been achieved, according to the invention, by adopting the idea of making a timing apparatus for two-stroke engines, which comprises a pair of identical toothed wheels one of which is eccentrically keyed on the drive shaft and the other eccentrically keyed on the gearbox shaft, and are 180° out of phase to each other.

The advantages deriving from the present invention consist essentially in that it is possible to prolong the exhaust and scavange cycle while increasing the power delivered by the engine; that it is possible to reduce the height of the exhaust ports and, thereby, increase the effective cylinder capacity of the engine, the weight and dimensions being equal, which results particularly useful in the racing engines; that the proposed apparatus can be used also on opposite-piston engines, unidirectional scavenge engines, Junker-type engines, in order to reduce the quantity of unburnt fuel let out during the exhaust cycle and, thus, to fill the combustion chamber almost completely.

BRIEF DESCRIPTION OF THE DRAWINGS

These and other advantages and characteristics of the invention will be best understood by anyone skilled in the art from a reading of the following description in conjunction with the attached drawings given as a practical examplification of the invention, but not to be considered in a limitative sense; wherein.

DETAILED DESCRIPTION OF THE PREFERRED EMBODIMENT

Figure 2:
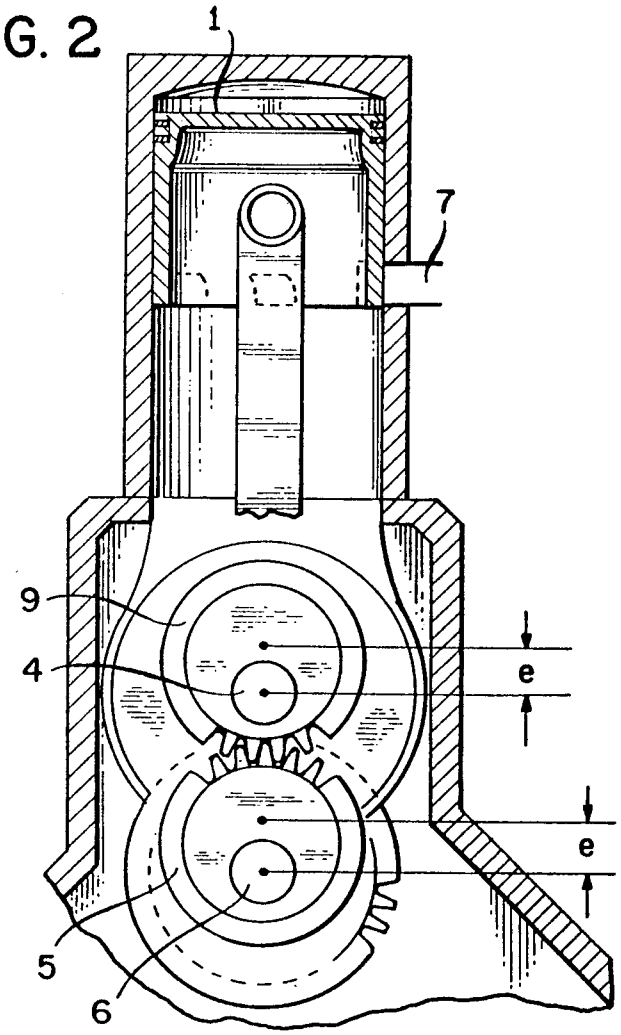
FIG. 2 shows the front view, partly in section, of the apparatus of FIG. 1, with the exhaust port being closed.
Figure 1:
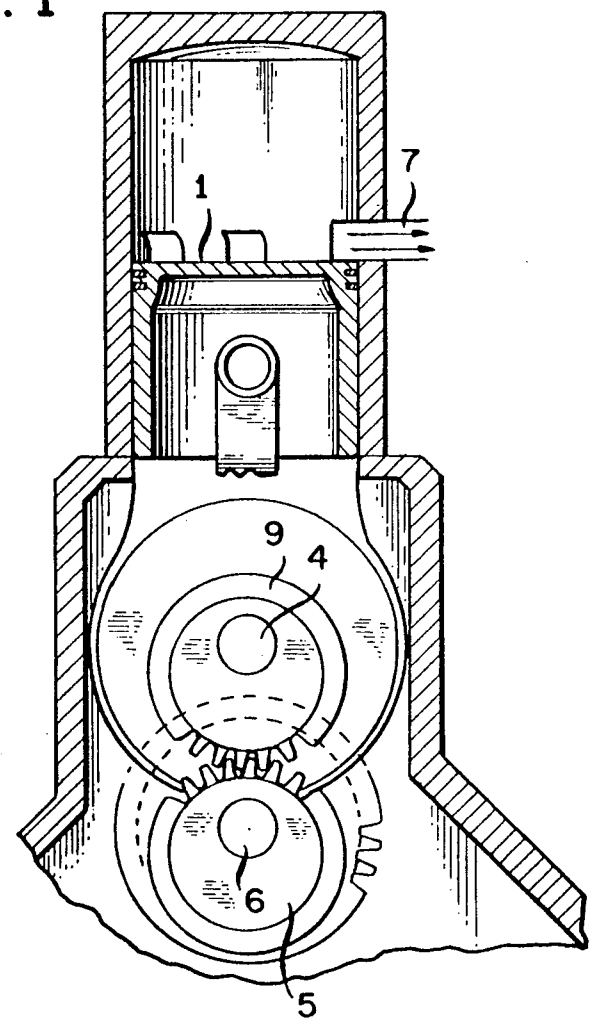
FIG. 1 shows the front view, partly in section, of an apparatus according to the invention, with the exhaust port being open.

Reduced to its basic structure and with reference to the attached drawings, a timing apparatus in a two-stroke internal combustion engine, according to the invention, comprises a pair of identical toothed wheels (9,5) one of which (9) is eccentrically keyed on the drive shaft (4) and the other (5) eccentrically keyed on the gearbox shaft (6), and are 180° out of phase to one another, so that upon each turn of shaft (6) at constant speed, the shaft (4) runs half a turn at minimum speed and half a turn at maximum speed. In this way, the stroke of piston (1) from the top dead center to the bottom dead center is decelerated, and the corresponding exhaust and scavenging cycle is prolonged, while the reverse stroke is made easier by the favourable ratio of transmission between the gears (9,5) of said pair.

According to an alternative embodiment of the invention, said gears (9,5) are of oval shape.

Advantageously, according to the invention, provision is made for the keying eccentricity (2) of gears (9,5) on relevant shafts (4,6) to be variable in relation to the desired duration of the exhaust port (7) opening cycle. Moreover, provision is made to use advantageously a pair of gears (9,5) having corrected toothing, to allow for a greater keying eccentricity.

I claim:

1. A timing apparatus in a two stroke internal combustion engine, comprising:

a drive shaft connected to a piston of the two stroke internal combustion engine; a gear box shaft positioned below said drive shaft and extending substantially parallel to said drive shaft; a first toothed wheel eccentrically keyed on said drive shaft to provide a minimum distance between said drive shaft and a toothed periphery of said first toothed wheel and a maximum distance between said drive shaft and said toothed periphery of said first toothed wheel, a second tooth wheel eccentrically keyed to said gear box shaft to provide a minimum distance between said gear box shaft and a toothed periphery of said second toothed wheel and to provide a maximum distance between said gear box shaft and said toothed periphery of said second toothed wheel, said first toothed wheel being substantially identical to said second toothed wheel and being engaged with said toothed periphery of said first toothed wheel at said minimum distance engaging said toothed periphery of said second toothed wheel at said maximum distance and said toothed periphery of said first toothed wheel at said maximum distance engaging said toothed periphery of said second toothed wheel at said minimum distance whereby upon each turn of said gear box shaft at constant speed, said drive shaft runs half a turn at a minimum speed and half a turn at a maximum speed.

2. Apparatus according to claim 5, wherein said said first toothed wheel and said second toothed wheel are oval in shape.

3. Apparatus according to claim 5, wherein a keying eccentricity of said toothed wheels on the respective gear box shaft and drive shaft can be varied according to a desired length of an exhaust port opening cycle.

4. Apparatus according to claim 5, wherein said toothed wheels include toothing shaped to allow for a greater keying eccentricity.

5. A timing apparatus according to claim 1, wherein said piston is connected to said drive shaft with said toothed periphery of said first toothed wheel at said maximum distance from said drive shaft engaging said toothed periphery of said second toothed wheel at said minimum distance from said gear box shaft at a bottom dead center position of said piston and said toothed periphery of said first toothed wheel at said minimum distance form said drive shaft engaging said toothed periphery of said second toothed wheel at said maximum distance from said gear box shaft at a top dead center position of said piston whereby a stroke of said piston from said top dead center to said bottom dead center is decelerated and said stroke of said piston from said bottom dead center to said top dead center is accelerated.

6. A timing apparatus in a two stroke internal combustion engine, comprising:

a drive shaft connected to a piston of the two stroke internal combustion engine; a gear box shaft positioned below said drive shaft and extending substantially parallel to said drive shaft; a first toothed wheel eccentrically keyed on said drive shaft to provide a minimum distance between said drive shaft and a toothed periphery of said first toothed wheel and a maximum distance between said drive shaft and said toothed periphery of said first toothed wheel, a second tooth wheel eccentrically keyed to said gear box shaft to provide a minimum distance between said gear box shaft and a toothed periphery of said second toothed wheel and to provide a maximum distance between said gear box shaft and said toothed periphery of said second toothed wheel, said first toothed wheel being substantially identical to said second toothed wheel and being engaged with said toothed periphery of said first toothed wheel at said minimum distance engaging said toothed periphery of said second toothed wheel at said maximum distance and said toothed periphery of said first toothed wheel at said maximum distance engaging each said tooth periphery of said second toothed wheel at said minimum distance whereby upon each turn of said gear box shaft at constant speed, said drive shaft runs half a turn at a minimum speed and half a turn at a maximum speed; wherein said piston is connected to said drive shaft with said toothed periphery of said first toothed wheel at said maximum distance from said drive shaft engaging said toothed periphery of said second toothed wheel at said minimum distance from said gear box shaft at a bottom dead center position of said piston and said toothed periphery of said first toothed wheel at said minimum distance from said drive shaft engaging said toothed periphery of said second toothed wheel at said maximum distance from said gear box shaft at a top dead center position of said piston whereby a stroke of said piston from said top dead center to said bottom dead center is decelerated and said stroke of said piston from said bottom dead center to said top dead center is accelerated; wherein said piston is connected to said drive shaft with teeth at said maximum distance from said drive shaft engaging teeth at said minimum distance from said gear box shaft at a piston bottom dead center position and teeth at said minimum distance from said drive shaft engaging teeth at said maximum distance from said gear box shaft at said top dead center position whereby a stroke of said piston from said top dead center to said bottom dead center is decelerated and said stroke of said piston from said bottom dead center to said top dead center is accelerated.

* * * * *